US007014549B1

(12) United States Patent
Cooper et al.

(10) Patent No.: US 7,014,549 B1
(45) Date of Patent: Mar. 21, 2006

(54) POLISHING PAD AND METHOD OF MAKING THE SAME

(75) Inventors: Alex Cooper, Brooklyn, NY (US); Yevgeny Bederak, Long Meadow, MA (US); Sergey Vladimirtsev, Brooklyn, NY (US)

(73) Assignee: Universal Photonics, Inc., Hicksville, NY (US)

( * ) Notice: Subject to any disclaimer, the term of this patent is extended or adjusted under 35 U.S.C. 154(b) by 0 days.

(21) Appl. No.: 11/011,339

(22) Filed: Dec. 14, 2004

(51) Int. Cl.
*B24D 17/00* (2006.01)

(52) U.S. Cl. ..... 451/490; 451/526; 451/921

(58) Field of Classification Search ..... 451/526, 451/921, 489, 490, 42, 499, 511, 512, 520, 451/521, 525, 514, 487, 437, 440
See application file for complete search history.

(56) References Cited

U.S. PATENT DOCUMENTS 1,964,240 A * 6/1934 Beard ..... 451/510
4,747,176 A * 5/1988 Parks ..... 15/230.16
6,875,090 B1 * 4/2005 Goulet et al. ..... 451/42

* cited by examiner

*Primary Examiner*—Dung Van Nguyen
(74) *Attorney, Agent, or Firm*—I. Zborovsky

(57) ABSTRACT

A polishing pad for polishing curved surfaces has a pad element having an axis, a central opening adjoining the axis and forming an inner edge, and an outer peripheral edge, first engaging means provided on the outer peripheral edge for engaging an outer periphery of a curved supporting body, and second engaging means provided on the inner edge of the pad element and engageable with a central opening of the curved supporting body, the first and second engaging means being harder than the pad element.

12 Claims, 8 Drawing Sheets

POLISHING PAD AND METHOD OF MAKING THE SAME

BACKGROUND OF THE INVENTION

The present invention relates generally to polishing pads. More particularly it relates to polishing pads which are used for polishing, prepolishing, grinding, etc. of spherical objects, for example lenses.

Polishing pads of the above mentioned general type are known in the art. They are composed of different materials and produced first by making a substantially flat pad and then glueing it to a curved, preferably part-spherical shell-shaped body.

When the polishing pad has been worn out, it has to be removed from the part-spherical body by dissolving the adhesive, and a new pad then is glued to the part-spherical body. The use of adhesive for glueing the polishing pad to the part-spherical body and dissolving the adhesive by solvents is environmentally an exceptionally unfriendly operation. It is not only labor and cost consuming but also is connected with contamination of environment with the adhesive and solvents. It is believed that it is advisable to improve the existing pads and methods of making the same.

SUMMARY OF THE INVENTION

Accordingly, it is an object of the present invention to provide a polishing pad of the above mentioned general type and a method of making the polishing pad which eliminates the use of adhesive and solvents and therefore are environmentally friendly, and less labor and time consuming.

In keeping with these objects and with others which will become apparent hereinafter, one feature of the present invention resides, briefly stated, in a polishing pad which has a pad element having an axis, a central opening adjoining said axis and forming an inner edge, and an outer peripheral edge; first engaging means provided in said outer peripheral edge for engaging an outer periphery of a curved supporting body; and a second engaging element provided on said inner edge and engageable with a central opening of the curved supporting body, said first and second engaging elements being harder than said pad element.

Another feature of the present invention resides, briefly stated, in a method of making a polishing pad, comprising the steps of providing a polishing element having an axis, a central opening adjoining said axis and forming an inner edge, and an outer peripheral edge; engaging by first engaging means provided in said outer peripheral edge an outer periphery of a curved supporting body; engaging by a second engaging element provided on said inner edge central opening of the curved supporting body; and forming said first and second engaging elements harder than said pad element.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
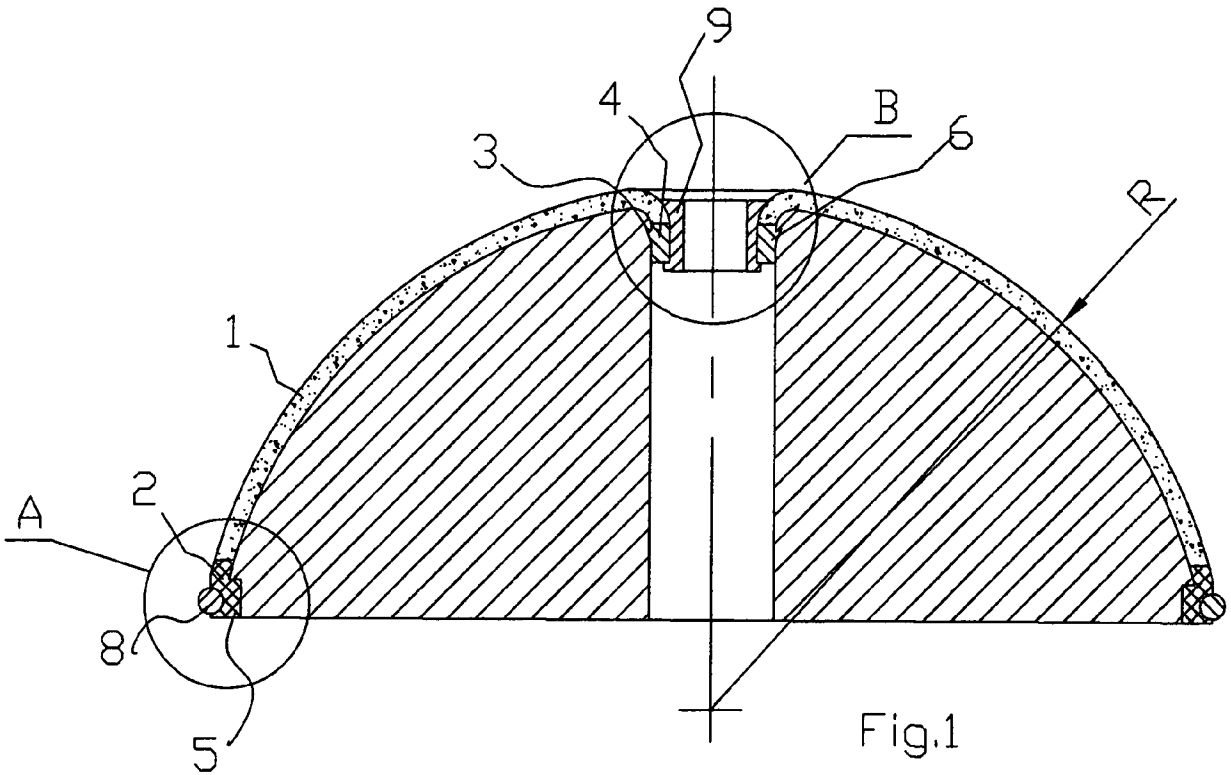
FIG. 1 is a view showing a polishing pad in accordance with the present invention which is mounted on a convex curved supporting body.

A polishing pad in accordance with the present invention is identified as a pad which can be used for polishing, grinding and other material removal operations. The polishing pad shown in FIG. 1 has a pad element which is identified with reference numeral 1. The pad element has an outer peripheral edge 2 and an inner edge 3 formed around a central opening 4 provided near a central axis.

In accordance with the present invention, the polishing pad is has a first engaging element 5 provided on the peripheral edge 2 and a second engaging element 6 provided on the edge 3. The engaging elements 5 and 6 are more rigid than the polishing element 1. In particular, the polishing pad element 1 can be composed for example of polyurethane, or can be composed of abrasive grains $CeO_2$, $Al_2$, $O_3ZrO_2$ which are embedded in a binder. The engaging elements 5 and 6 can be composed of hard polymer, such as for example nitrilbuthadiene rubber.

Figure 2:
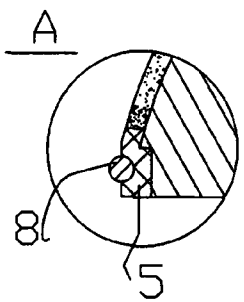
FIG. 2 is a view showing a cross-section of a peripheral edge of the polishing pad and the curved supporting body.
Figure 3:
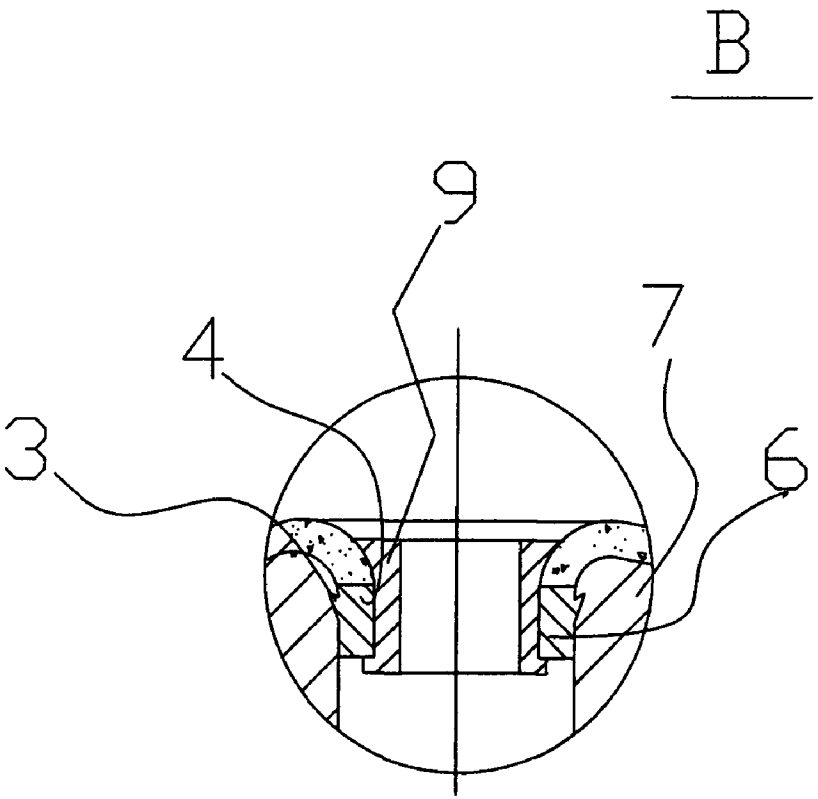
FIG. 3 is a view showing a cross-section of a central area of the polishing pad and the curved supporting body.
Figure 4:
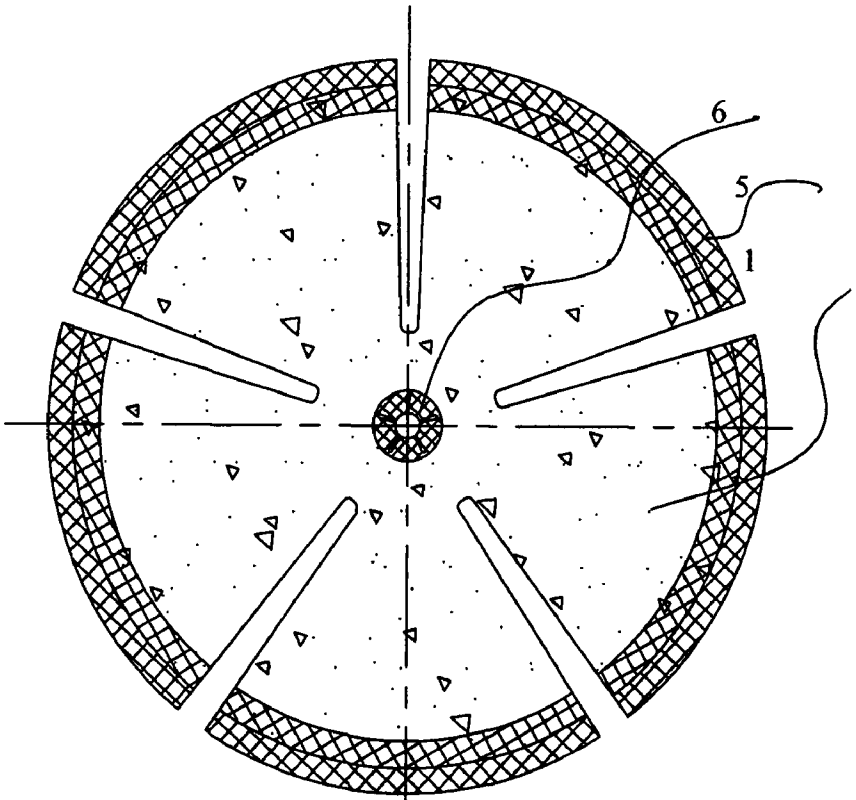
FIG. 4 is a view showing the polishing pad in a flat position from above.

As can be seen from FIGS. 1, 2, and 3, the engaging elements 5 and 6 are substantially circular and engage in a groove provided on a periphery of the curved supporting body 7 and in the region of an opening of the curved supporting body 7. The engaging elements 5 and 6 can be provided with an undercut, a step, etc. to produce a corresponding engagement.

As shown in FIG. 1, the engaging element 5 is retained in the peripheral groove of the curved supporting body 7 by a locking element which can be formed as a circular locking ring 8, while the engaging element 6 is retained in the groove of the supporting body 7 by a bushing 9.

With such a construction it is not necessary to attach the pad element 1 to the curved (part-spherical) supporting body by an adhesive.

Figure 5:
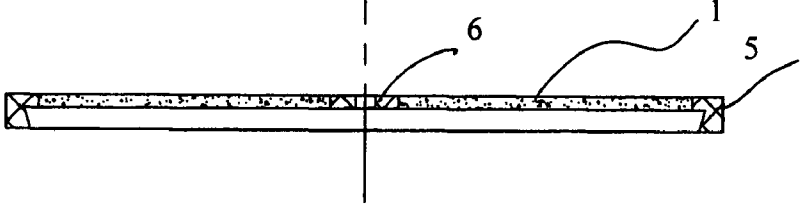
FIG. 5 is a view showing a cross-section of the polishing pad shown in FIG. 4.

As can be seen from FIG. 5 the pad element 1 and the outer engaging element 5 are provided with slots which extend from the periphery toward the central axis over a part of radius so as to allow fitting of the pad element 1 and the engaging element 5 over the curved supporting body 7. The pad element 1 and the engaging element 5 are also provided with slots extending from the central axis radially outwardly to allow bending of the central part of the pad element 1 and the engaging element 6 into an opening of the curved supporting body.

Figure 6:
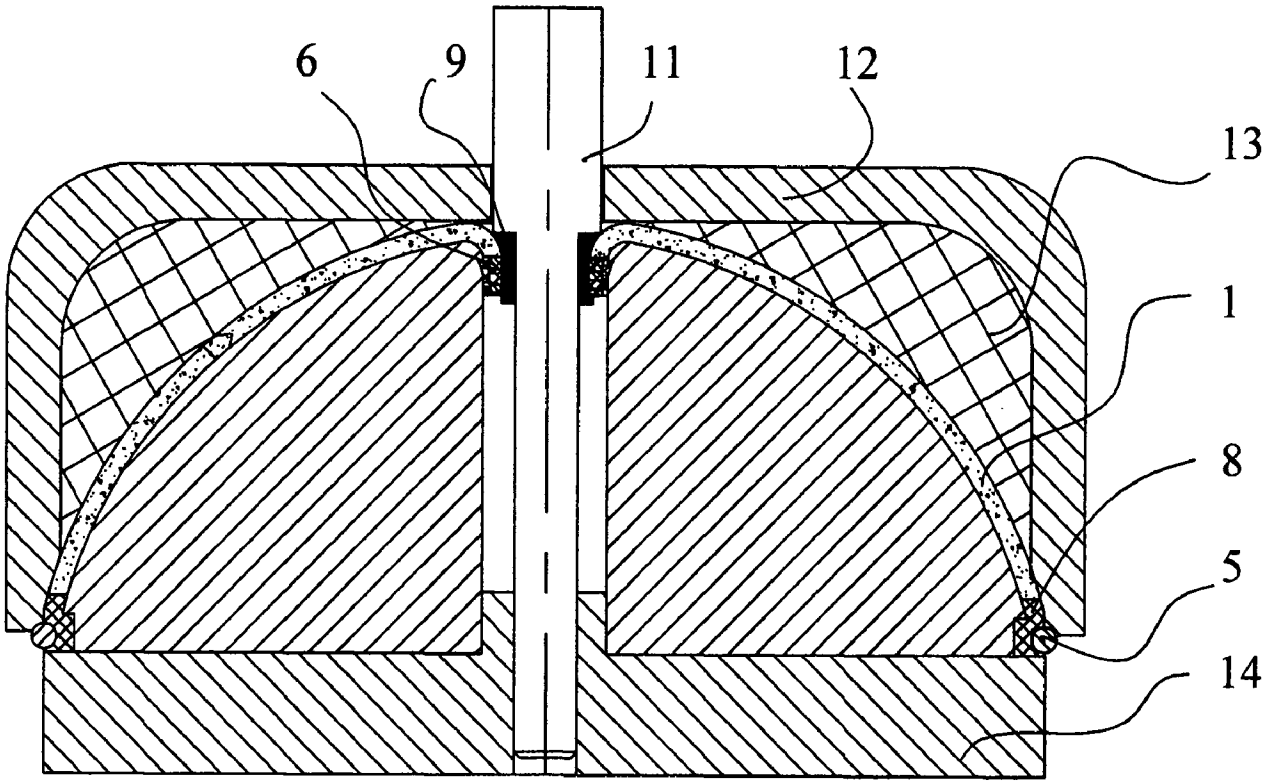
FIG. 6 is a view illustrating a process of attaching the polishing pad to the curved supporting body.

The pad element 1 with the engaging elements 5 and 6 are attachable to the curved supporting body as shown in FIG. 6. For this purpose a centering pin 11, a forming cup 12, and a sponge-like element 13 are utilized. When the forming cup with the sponge-like element is placed over the pad element 1 and the centering pin is introduced into the opening 1, the locking element 8 locks the engaging element 5 in the groove on the periphery of the curved body, the centering pin locks the bushing in the inner opening of the supporting body and therefore fixes the engaging element 6, and the sponge-element ensures a complete abutment of the inner surface of the pad element over the outer curved surface of the curved body.

A base plate 14 is provided at the lower end of the device to support all elements.

Figure 7:
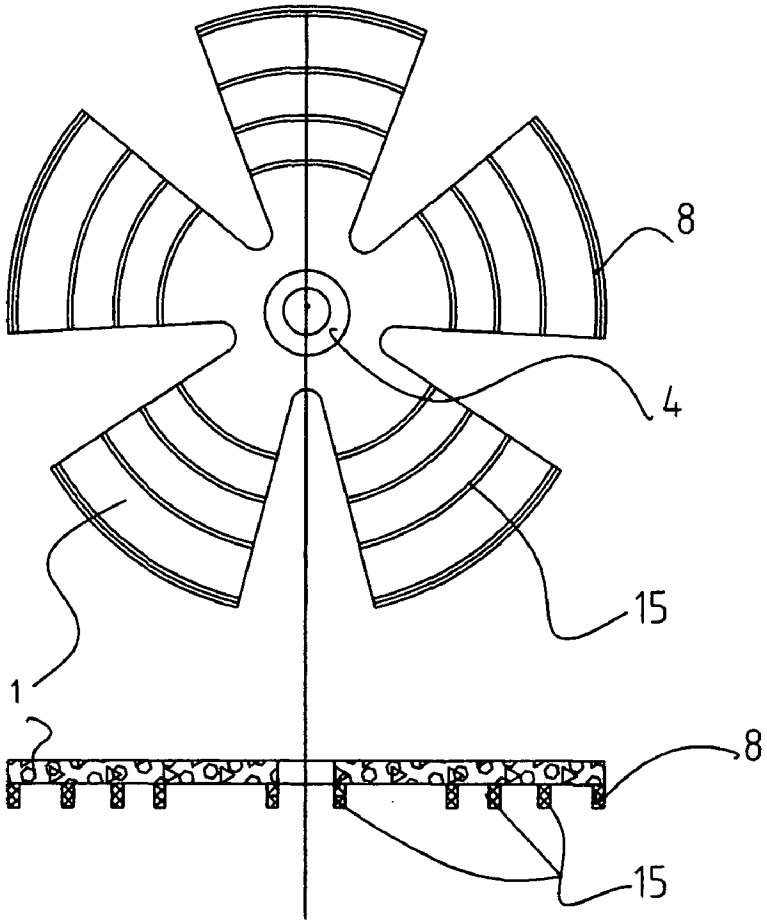
FIGS. 7 and 8 are views showing two further modifications of the polishing pad in accordance with the present invention.
Figure 8:
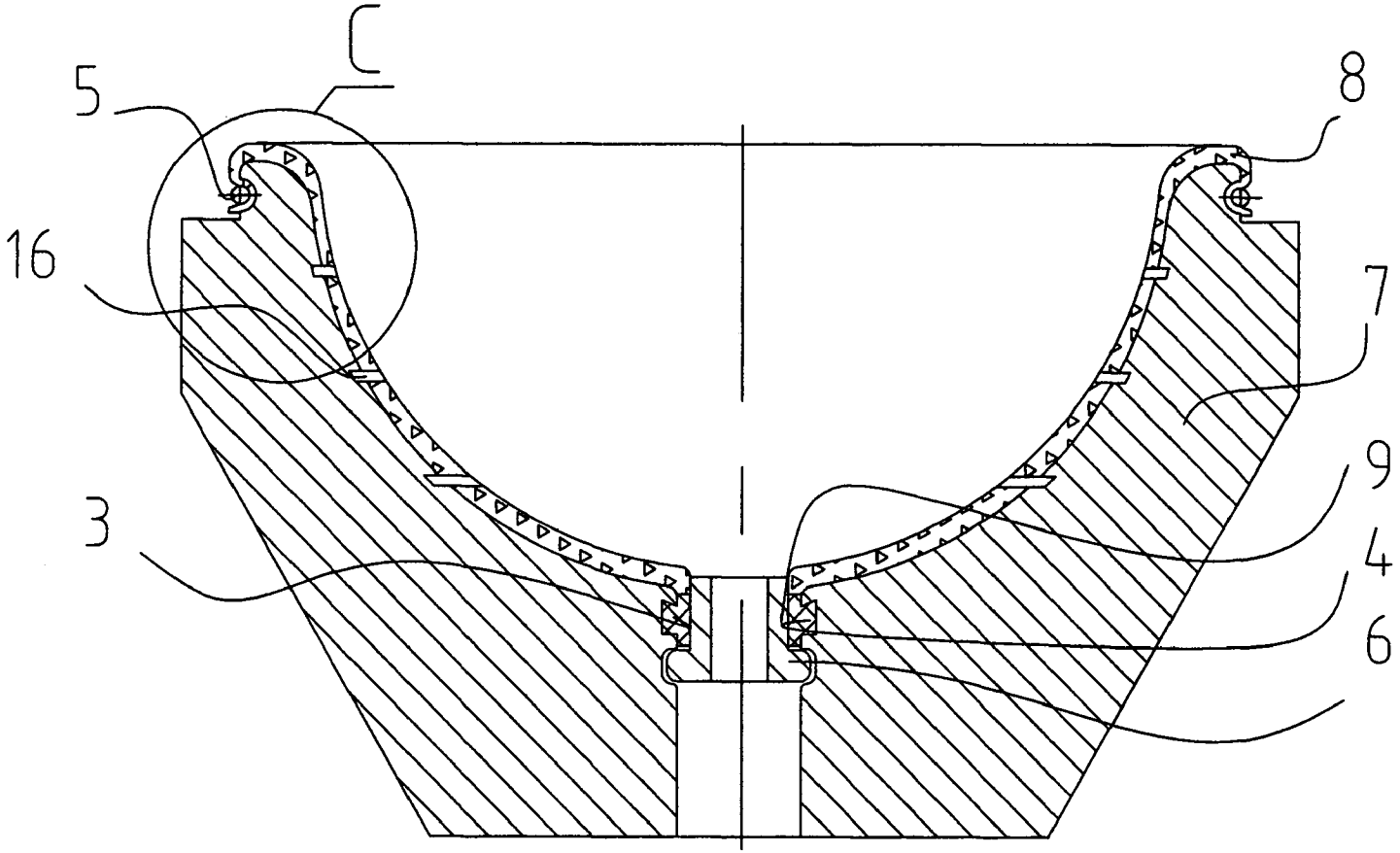
Figure 9:
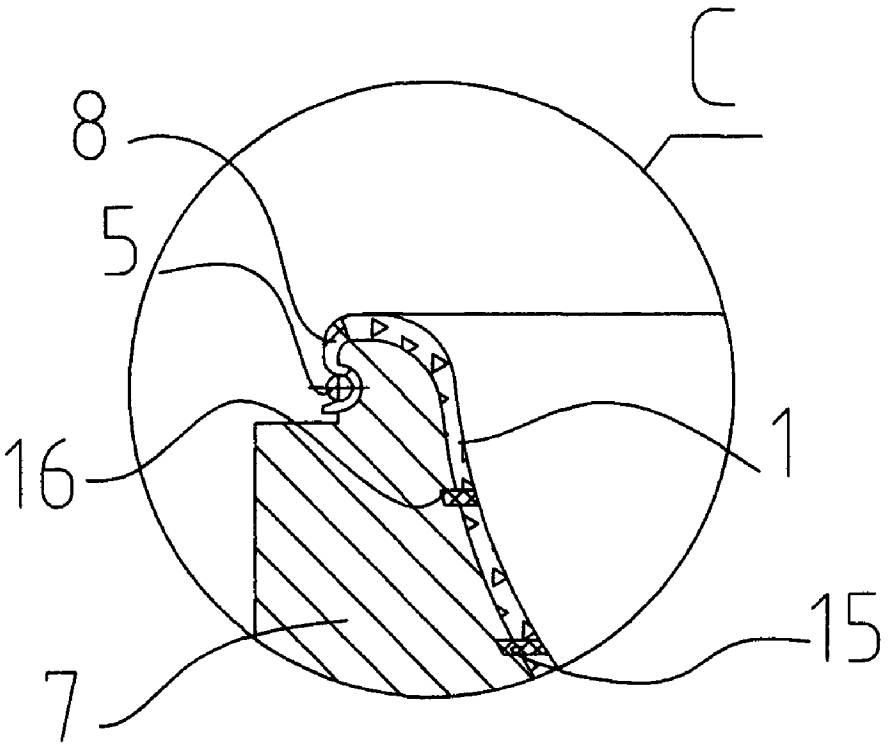
FIG. 9 is a view showing an area C of FIG. 8.

As shown in FIGS. 7–9 the pad element 1 can be provided with inner formations for holding on the supporting body in FIG. 7. The inner formations are formed as local projections 15 provided on the inner surface of the pad element and engageable into grooves 16 on the outer surface of the curved supporting body, for example by snapping action.

Figure 10:
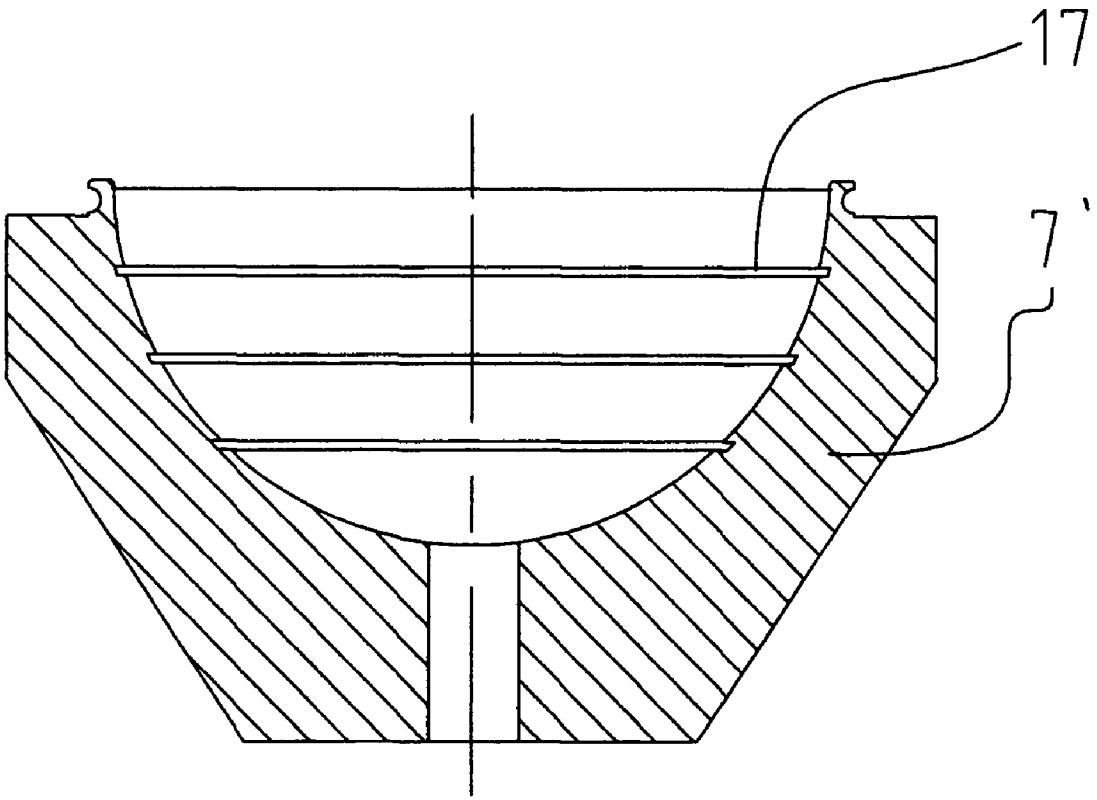
FIG. 10 is a view showing a cross-section of a concave curved supporting body.

While in the previous embodiments the curved supporting body 7 is convex, in the embodiment of FIG. 10 the curved supporting body 7' is concave and has grooves 17 for engagement by formations on the pad element.

It will be understood that each of the elements described above, or two or more together, may also find a useful application in other types of constructions and methods differing from the types described above.

While the invention has been illustrated and described as embodied in a polishing pad and a method of making the same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A polishing pad for polishing curved surfaces, comprising a curved supporting body having an axis, a central opening adjoining said axis, and an outer periphery; a pad element having a first uninterrupted circular engaging element provided on an outer edge of said pad element and engaging in a groove in the outer periphery of said curved supporting body, and a second uninterrupted circular engaging element provided on an inner edge of said pad element and engaging into an interior of said central opening of said curved supporting body, said first and second engaging elements being harder than said pad element.

2. A polishing pad as defined in claim 1, wherein said pad element on its inner surface is provided with a formation engageable in the curved supporting body.

3. A polishing pad as defined in claim 2, wherein said formation is formed as a local protection.

4. A method of producing a polishing pad, comprising the steps of providing a curved supporting body having an axis, a central opening adjoining said axis, and an outer periphery; engaging by a first uninterrupted circular engaging element provided on an outer peripheral edge of a pad element in a groove in the outer periphery of the curved supporting body; engaging by a second uninterrupted circular engaging element provided on an inner edge of the pad element into an interior of the central opening of the curved supporting body, and configuring said first and second engaging elements harder than said pad element.

5. A method a defined in claim 4; and further comprising providing in said pad element a plurality of slots extending from said central opening over a part of a radial distance of said pad element.

6. A method as defined in claim 4; and further comprising providing in said pad element a plurality of slots extending from said outer peripheral edge over a part of a radial distance of said pad element.

7. A method as defined in claim 4; and further comprising fixing said first engaging element in the groove on a periphery of the curved supporting body by a locking element surrounding said first engaging element.

8. A method as defined in claim 4; and further comprising fixing said second engaging element in the groove of the curved supporting body by a bushing which is introduced into an interior of said opening of said pad element.

9. A method as defined in claim 7; and further comprising pressing said locking element on said first engaging element by an additional cup-shaped pressing element.

10. A method as defined in claim 4; and further comprising pressing said pad element against the curved supporting body by a surrounding elastic element and an outer cup-shaped element which surrounds said elastic element.

11. A method as defined in claim 4; and further comprising engaging the curved supporting body by a formation provided on inner surface of the pad element.

12. A method as defined in claim 4, wherein said engaging includes engaging by the formation formed as a local projection.

* * * * *